United States Patent [19]

Skipper

[11] Patent Number: 4,923,011

[45] Date of Patent: May 8, 1990

[54] DRILL STEM MUD WIPING APPARATUS

[76] Inventor: Uvon Skipper, 7409 S. Rice Ave., Bellaire, Tex. 77401

[21] Appl. No.: 396,233

[22] Filed: Aug. 21, 1989

[51] Int. Cl.[5] ..... E21B 12/06; E21B 33/08; E21B 37/00

[52] U.S. Cl. ..... 166/311; 166/177; 166/170

[58] Field of Search ..... 166/311, 177, 170, 174, 166/176, 101, 148, 153, 187, 192; 134/22.11, 22.12; 175/316, 318; 15/104.05, 104.061

[56] References Cited

U.S. PATENT DOCUMENTS

| | | | |
|---|---|---|---|
| Re. 20,546 | 11/1937 | Otis . | |
| 1,949,498 | 3/1934 | Stone et al. . | |
| 2,052,006 | 8/1936 | Taylor . | |
| 2,114,373 | 4/1938 | Edwards . | |
| 2,245,128 | 6/1941 | Gardner | 166/177 |
| 2,257,080 | 9/1941 | Turner | 166/177 X |
| 2,274,940 | 3/1942 | Stoddard . | |
| 2,460,481 | 2/1949 | Abel . | |
| 2,577,068 | 12/1951 | Baker . | |
| 2,578,900 | 12/1951 | Ragan . | |
| 2,598,512 | 5/1952 | Cypher . | |
| 2,633,202 | 3/1953 | Hartsell . | |
| 2,739,652 | 3/1956 | Hartsell . | |
| 2,740,480 | 4/1956 | Cox | 166/170 |
| 2,806,532 | 9/1957 | Baker et al. . | |
| 2,880,805 | 4/1959 | Nelson et al. . | |
| 3,052,302 | 9/1962 | Lagucki . | |
| 3,164,210 | 1/1965 | Lewis . | |
| 3,276,520 | 10/1966 | Arnold . | |
| 3,294,173 | 12/1966 | Hodges . | |
| 3,378,069 | 4/1968 | Fields . | |
| 3,394,763 | 7/1968 | Page, Jr. | 166/311 X |
| 3,485,297 | 12/1969 | Sutliff et al. . | |
| 4,285,402 | 8/1981 | Brieger | 166/311 |
| 4,287,948 | 9/1981 | Haggard | 166/170 |
| 4,580,635 | 4/1986 | Radford et al. | 166/311 |

FOREIGN PATENT DOCUMENTS

| | | |
|---|---|---|
| 826475 | 11/1969 | Canada . |

OTHER PUBLICATIONS

Safe Trip Mud-Slugger, brochure, Houston, Tex., p. 2.

*Primary Examiner*—Stephen J. Novosad

[57] ABSTRACT

A wiping tool for free fall in a drill stem is disclosed. The wiping tool is adapted to be dropped in the drill stem to wipe the inner wall. It is constructed with an elongate mandrel terminating at upper and lower subs. The upper sub supports a fishing neck and the lower stub encloses a check valve assembly. Adjustable weight means are affixed to the lower sub. Wiping is accomplished by an elongate sleeve having narrow upper and lower ends slideably mounted on the central mandrel, and said sleeve is enlarged at central portions to a diameter sufficient to wipe the wall of internal upset pipe, and wherein said sleeve is resilient, and is therefore able to reduce in diameter on passing through an internal upset and resiliently restores to the initial diameter after passing through the upset.

19 Claims, 2 Drawing Sheets

DRILL STEM MUD WIPING APPARATUS

BACKGROUND OF THE DISCLOSURE

This apparatus is directed to a device to be placed in a drill stem at the time that the drill stem is pulled from the well borehole during drilling and, more particularly, is a device for weighting the column of mud in the drill stem.

During drilling of a well, it is necessary to periodically removed the drill stem from the borehole, typically to replace the drill bit. When this occurs, the drill stem is normally lifted up and disassembled joint by joint or perhaps stand by stand. In the process of removing the pipe from the borehole, it is normally lifted in a wet condition and, upon unthreading, may spill drilling fluid on the rig floor creating a risky condition. Moreover, this destroys the hydrostatic balance which existed in the borehole. Heretofore, this has been overcome by slugging the column of mud in the drill stem with a slug of drilling fluid of heavier density so that it will tend to keep the level of mud down in the drill pipe due to the hydrostatic unbalance created. This requires use of different type material in the drilling fluid such as the use of an oil base mud when the column of mud otherwise located in the borehole is a clay based mud. Mixing the two is undesirable. Sometimes as in the case of oil base mud systems it is necessary to remove the weight materials used to obtain the mud balance required for drilling.

Various and sundry devices have been provided heretofore and representative devices are disclosed in patents 2,578,900, also 2,633,202 and 3,276,520. The latter shows a set of resilient cups while the older of these references shows modified cups having overlips. The intermediate reference sets forth a sleeve. The several references however do not set forth a device which is so aptly able to pass through internal upset pipe which requires a narrowing of the tool on each occasion of encountering the internally constructed shoulders located at the tool joints.

The present apparatus discloses an elongate member which is buoyantly carried on the top of the mud column in the drill stem as it is being pulled and which includes a central elongate mandrel. The mandrel is of relatively narrow diameter to receive thereon a telescoped and slidable resilient sleeve. The resilient sleeve is not shaped as a cup, but rather incorporates upper and lower ends which are relatively narrow and are mounted on circular rings to enable telescoping movement of each end independently on the mandrel. The sleeve bows outwardly at the central portions and defines a resilient wiping surface. This surface is able to pass through the internal upset pipe. When it does, the sleeve is constricted only slightly, forcing the two ends farther apart, but they are both free to move. The two ends of the sleeve are arranged in a circular construction around the mandrel. Conveniently, shoulders at the upper and lower ends of the sleeve supported by the mandrel define the control sleeve position, but such movement is nevertheless permitted during transition through an internal upset. The transition thus occurs as the device is traveling through the drill stem and yet permits the sleeve to slide through the internal upset, shrinking at the fatter central portion, forcing the two ends thereof relatively apart, and moving at one end or the other to accommodate the appropriate elongation on diametric shrinkage, and further restoring to the original shape after transition through the internal upset. This is markedly different from cups which face upwardly or downwardly. Likewise, it is different from sleeves of substantially uniform diameter, and is substantially different from the wiping action provided by such devices.

One modification of the present apparatus is the incorporation of a split ring defining a plurality of independent collet fingers arranged around a tapered surface. This is located at the upper portions of the tool to thereby define a slip assembly which blocks upward movement of the tool in the event of a blowout. This functions in conjunction with the resilient or wiping rubber just mentioned, and is able to hold against specified levels of upward pressure transmitted through the column of mud in the drill stem to the present apparatus. There is in addition to that an axial passage through the tool which enables drilling mud to be pumped down through the tool, entering the tool at the upward end and travelling axially along the length of the mandrel in the interior and passing out through the bottom of the tool. This path is made exclusively one way by incorporation of a check valve in the pathway. That extends through the mandrel which is in the turn supportive of the sleeve mentioned above.

The foregoing briefly sets out certain aspects of the present disclosure, but details of the present apparatus will become more readily apparent and understood in conjunction with the drawings of the preferred embodiment, and it is therefore a structure including the components illustrated discussed below for the preferred embodiment.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
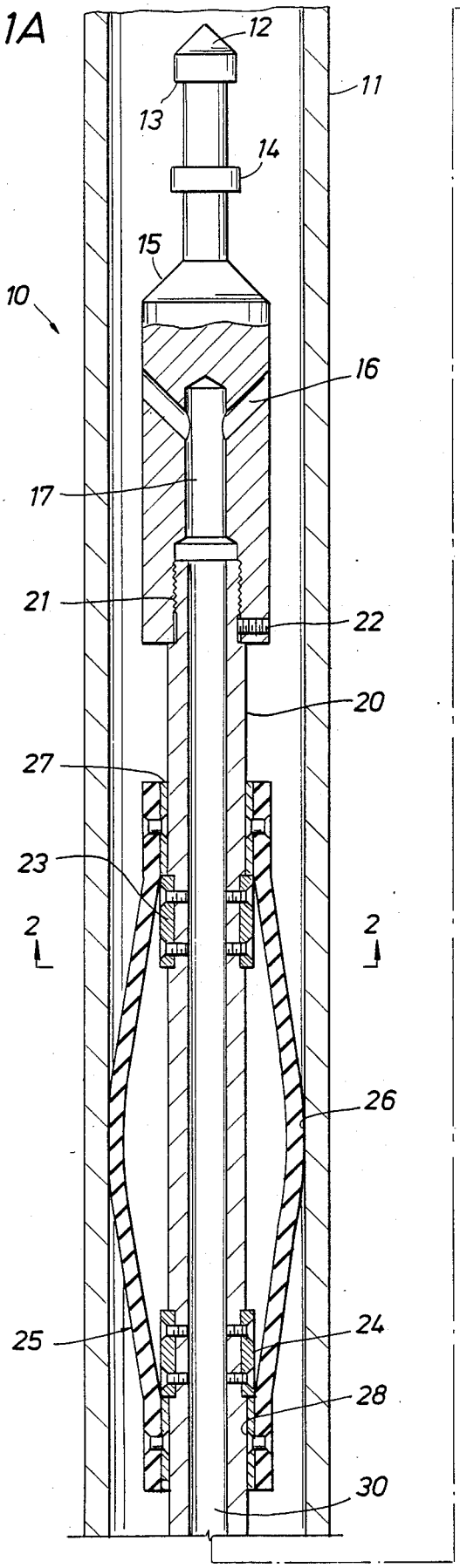
FIGS. 1A and 1B are portions considered serially and show the preferred embodiment of the present apparatus particularly featuring a bulging sleeve having narrowed upper and lower ends for telescoping on a support mandrel.

Attention is now directed to FIG. 1A of the drawings where the numeral 10 identifies the present apparatus. It will be described generally hereinafter as the sleeved wiper but a better understanding thereof will be obtained on review of the preferred embodiment. Proceeding from the top of the apparatus, it is located in a drill pipe 11 and incorporates a fishing neck 12 which has an undercut shoulder at 13 to enable engagement by a fishing tool. There in an engagement ring 14 therebelow. The fishing neck extends to an enlargement 15, thus forming an elongate cylindrical or tubular body portion. This is a solid member which is drilled with several small passages 16 which collectively connect with a central passage 17 which opens into and flows through an elongate central mandrel 20. The mandrel 20 is a separate piece and yet is joined at the threads 21 and is held or fastened to the cylindrical member 15 by means of a set screw 22. The mandrel supports an encircling lock ring 23 which is fastened in place by one or more fasteners. A similar lock ring 24 is positioned therebelow. The two lock rings provide spaced registration shoulders. The shoulders limit the travel of an encircling sleeve 25 which is constructed with a central enlarged portion in contact with the surrounding pipe 11, the contact area being indicated by the numeral 26. The upper and lower ends of the sleeve are constructed in similar fashion. The sleeve is made of resilient material and is affixed to an end located stiffening ring. The upper ring 27 is thus identical to the lower ring 28 and the two rings limit telescoping movement of the sleeve.

The rings 27 and 28 are free to move away from the adjacent shoulders. In that sense, they can separate from the shoulders 23 and 24. This permits some slippage of the sleeve 25 along the mandrel 20 which supports the sleeve. Moreover, the sleeve is relatively narrow where it fits around the mandrel so that the leading edge of the sleeve will not contact any sharp edges or catch on any internal upsets. The internal upset does not extend sufficiently radially inwardly to catch against the shoulders at the ends of the sleeve; rather the sleeve will pass partially into the internal upset. The internal upset will squeeze against the fatter portion at 26, and force it into a narrow diameter. When squeezing occurs in this region 26 as the sleeve passes through an internal upset, the sleeve becomes more narrow and it simultaneously becomes longer, forcing the two ends farther apart. As they move apart, they slide along the mandrel and are free to disengage the confinement obtained by the two shoulders 23 and 24 on the interior of the sleeve. This in turn changes the relative dimensions of the sleeve and thereby permits the sleeve to travel even farther along the mandrel in one direction or the other. In that sense, the sleeve is not fastened but is free to move in telescoping fashion in a limited range of movement along the mandrel. Moreover, the sleeve is free to initially shrink as it passes through the internal upset initiating momentary elongation.

The resilient material which makes up the sleeve 25 is preferably constructed to have a bias or set which restores the sleeve to the shape illustrated in the drawings. To be sure, the relative shrinking of the sleeve when an internal upset is encountered causes some measure of elongation and hence causes limited telescoping movement. In the ordinary course of events, the tool 10 travels relatively downward in FIG. 1 and is therefore constructed to encounter the internal upset which moves from the lower part to the upper part of FIG. 1A, relatively speaking. This procedure enables the sleeve 25 to smoothly pass through the internal upset without running the risk of snagging or otherwise dragging a sharp or abrupt lip across the internal upset. The absence of the sharp lip is an enhancement which permits the sleeve to go through the internal upset with less difficulty and with greater facility.

Figure 1B:
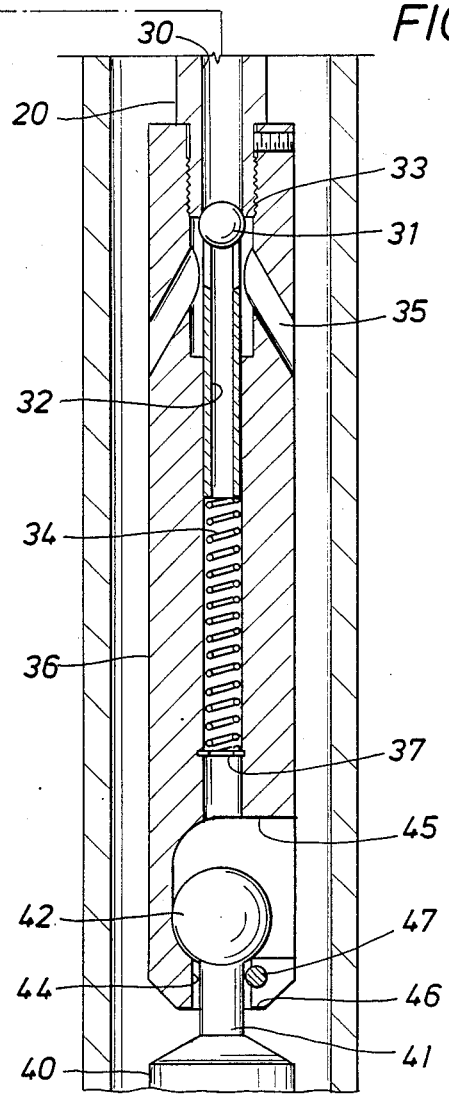
Figure 2:
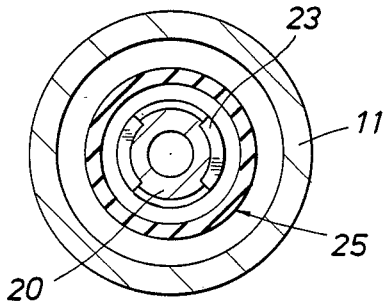
FIG. 2 is a sectional view along the line 2—2 of FIG. 1A showing details of construction of the mandrel which supports the bulging sleeve.

The mandrel 20 extends farther along the apparatus as shown in FIG. 1B. The mandrel provides the axial flow path 30 which terminates at a check valve element 31 held in place by a centering sleeve 32. The check valve bears against a surrounding shoulder to provide closure against upward flow, and the check valve is forced off the valve seat 33 by pumping down through the tool. The valve element 31 is forced downwardly in that event, working against the coil spring 34. The coil spring provides a bias force against the check valve. Below the check valve, the axial passage 30 divides into several similar passages 35 which branch outwardly to deliver fluid flow into the exterior area and below the sleeve.

The mandrel 20 threads at the lower end to a sub 36 which is axially drilled to receive the check valve spring 34 secured above a snap ring 37. In addition, the mandrel 20 supports the elongate tubular enlargement 36 threaded thereto so that support is also provided for attached sinker bars.

The apparatus of the present disclosure as described to this juncture is not adequate in weight. It is ordinarily used in a situation where it must relatively fall through the pipe 11. This fall positions the apparatus to float, in the fashion of a cork, on top of a column of drilling fluid. Ideally, it should be supported by the column of fluid at a specified location in the drill stem. In this particular instance, sinker bars ordinarily have to be added to control the weight of the equipment and thereby assure that the present apparatus forces the column of fluid down in the drill stem as the drill stem is disassembled on removal from the well borehole. Accordingly, one or more sinker bars typically is attached to the apparatus and hang therebelow. It is desirable that they attach with a pivotal connection. In FIG. 1B, such a sinker bar is indicated at 40. The sinker bar terminates at a narrow neck 41 which supports a spherical knuckle joint 42. The knuckle 42 is formed with a specified diameter. The end of the sub 36 is drilled with a hole to form a passage 44 centered in the enlargement. The passage 44 extends into a larger cavity 45. A lateral slot is cut from the cavity 45 and extends to one side of the sub 36. The central passage 44 is larger than the diameter of the narrow neck 41. A slot 46 is cut below the cavity 45 and is sufficient in width to enable the narrow neck 41 to insert through the slot. Then, a transverse pin 47 is fastened across the slot and serves as a lock pin to assure that the knuckle 42 is held in place. It cannot escape after the pin 47 has been inserted.

The engagement described above is easily accomplished when the pin 47 is removed. The spherical knuckle 42 is inserted into the cavity 45 which is larger in all dimensions and able to receive the enlargement. This typically occurs with the neck extending at right angles to the axis of the sub 36. The sinker bar is then rotated to bring the narrow neck 41 into the axially aligned position shown in FIG. 1B whereupon the pin 47 is then inserted to serve as a lock and thereby fasten the knuckle in position. This type connection is used to attach a first sinker bar 40; that sinker bar can terminate in a duplicate of the knuckle and cavity arrangement just described so that two or more consecutive sinker bars can be attached to the equipment.

OPERATION OF EMBODIMENT 10

This embodiment is assembled in the fashion just described with one or more sinker bars affixed. Typically, and at the time that the drill stem must be removed from the borehole, the Kelly is unthreaded from the drill stem and the present apparatus is dropped into the drill pipe. It will fall down the drill stem in the pipe 11 until the predetermined depth setting is reached. So to speak, it will settle on the top of this. Buoyancy is controlled by increasing the weight as desired by attaching one or more sinker bars. The amount of weight added by the sinker bars is in part dependent on the density of the drilling fluid, and thus the sinker bars can be tailored to a particular weight for obtaining a particular buoyance in a given circumstance. The apparatus will, in that sense, float inside the drill stem on the standing column of mud. The added weight which the present apparatus imparts will serve the intended purpose of a slug of heavier weight mud. Thus, it is not necessary to commingle types of mud by increasing the weight of mud. Rather, the present apparatus substitutes for such an increased weight in the column of drilling fluid. As the drill stem is removed from the well, it is normally disassembled from the very top end by periodically engaging and disengaging the overhead hook supported by the draw works in the derrick. As each joint or stand of pipe is removed, present apparatus will fall farther down the drill stem. Ultimately, it will land at the drill collars.

The present apparatus pushes the drilling fluid down in the pipe 11. As it falls relatively in the pipe, the sleeve 25 tends to wipe the wall clean and dry. This forces drilling fluid clinging to the wall back down into the column of mud standing in the drill stem.

Consider a typical set of dimensions. Assume the well is being drilled with pipe which is identified as a nominal 5 inch drill string. That pipe is constructed with an internal upset. The ID in the pipe is 4.276 inches, and the ID at the upset is smaller, being approximately 3.750 inches. The sleve 25 is constructed so that in the relaxed state it has a diameter sufficient to accomplish the necessary sealing effect, approximately equal to the ID of the pipe, or perhaps 5% greater. This assures that there is an inherent bias in the relaxed sleeve which urges it into contact and which permits wearing away of the sleeve over a period of time. Moreover, in this relaxed state, the sleeve is carried along the pipe between tool joints to provide wiping action. The sleeve is constructed so that the OD of the sleeve at the narrow ends is much smaller. This prevents the sleeve ends from snagging on the upsets at the tool joints. The clearance is sufficient that the ends of the sleeve pass freely without impediment through the upsets with substantial clearance. The region of contact where the upset first begins to constrict or narrow the sleeve is substantially away from the two ends and is at the mid portions where the bulge is located. Gradual angles are involved and hence the risk of snagging is simply avoided. Wear occurs in the central regions, but that is minimal in view of the very gradual angle of intercept between the sleeve bulging at the center which contacts the upsets. Moreover, the preferred thickness of the sleeve material is in the range of about 0.3 to about 0.6 centimeters, a sufficient thickness to provide resonable stiffness where the rubber material has a hardness of about 30 to 70 durometer on the Shore A scale.

When the sleeve is contracted at an internal upset, it is squeezed and thereby elongates. Moreover, it is free at both ends to permit elongation and in that sense is not confined. It is confined to a region or a portion of the mandrel 20 but is free to telescope relatively as elongation occurs. It is confirmed by the two rings 23 and 24 which prevent excessive axial movement.

DESCRIPTION OF ALTERNATE EMBODIMENT

Figure 3:
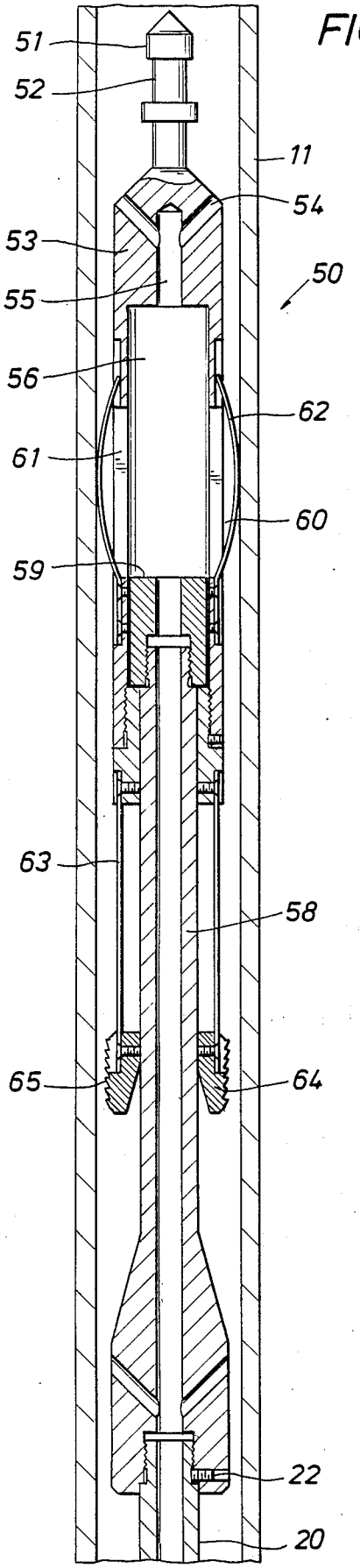
FIG. 3 shows a slip setting mechanism in the raised or exended position which causes the slip to retract and avoid gripping the wall of the surrounding pipe.
Figure 4:
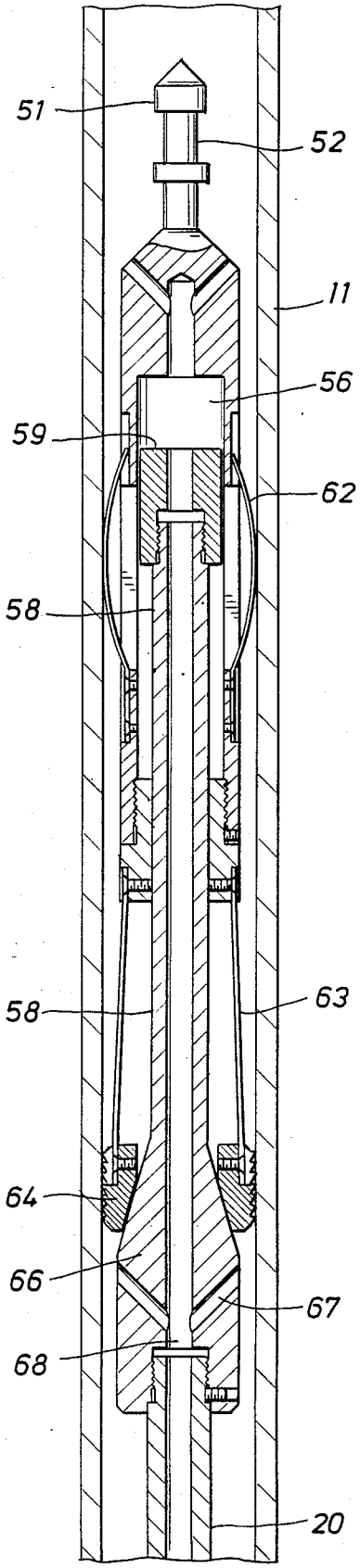
FIG. 4 is a view similar to FIG. 3 showing the slips in the extended position for locking in contrast with the retracted position of FIG. 3.

Attention is now directed to FIG. 3 of the drawings which shows an alternate addition to the apparatus 10 shown in FIG. 1 and which is affixed to the top end of the mandrel 20 and which can be installed or removed by threading and unthreading to the mandrel 20. The attachment in FIG. 3 will be described as a slip assembly 50, and attaches at the upper end of the mandrel. The slip assembly includes the industry standard spear 51 above the neck 52 and that in turn connects with the enlargement 52. Drilling fluid can flow into a set of ports 54 and they in turn connect with a passage 55 opening into an enlarged chamber 56. The chamber 56 is enlarged as shown in the contrast of FIGS. 3 and 4 to receive axial telescoping movement of a slip mandrel 58. The slip mandrel supports a plunger head 59 at the top end which is sized to fit within the chamber 56. The chamber 56 is constructed within a surrounding cylindrical skirt 60, and the skirt 60 encloses the plunger 59 permitting reciprocating movement. FIGS. 3 and 4 show the contrast in plunger position. There is, however, a slot 61 cut at one or more locations which partially drains the chamber 56 to prevent hydrostatic pressure build-up on plunger movement. Even when the plunger moves beyond the slot as shown in FIG. 4, there is sufficient leakage that no pressure build-up occurs. Moreover, plunger movement in this fashion repositions the plunger in the upper portions of the chamber 56 to permit telescoping movement described.

The skirt is a surrounding cylindrical structure which conveniently supports bow shaped centralizer springs 62 which center the equipment in the pipe 11. This enables movement without dragging against the pipe wall. Rather, the centralized components shown in FIG. 3 are free to telescope in setting the slips. The enlargement 53 supports a set of spring loaded elongated downwardly extending fingers 63, therebeing a plurality thereof located around the central mandrel 58, and the fingers all terminate at wedge shaped slip members 64. The slips 64 are provided with an external surface having serrations 65 to provide a grip against the inner surface of the drill pipe 11. As shown in FIG. 3 the slip segments are located adjacent the mandrel 58 and are not deflected. They are in the radially retracted position. The slip segments 64 are permitted to deflect radially outwardly but there is not reason for such movement at this juncture; rather, that is a accomplished on telescoping movement as shown in FIG. 4 of the drawings. There, the slip segments 64 are positioned against the tapered surface of an enlargement 66 which presents a tapered face approximately matching the angle of the under face of the slip segments 64. This linear movement on the mandrel 58 causes the slip segments to deflect outwardly. When they do, they are brought into engagement with the surrounding pipe wall. The enlarged region 66 is thicker in diameter to have additional feed passages 67 opening into the axial passage 68. That opens into the top end of the hollow mandrel 20 previously discussed, thereby enabling the slip assembly 50 to be affixed to the top of the mandrel 20.

OPERATION OF THE SLIP ASSEMBLY

Ordinarily, the relative movement of the apparatus 10 is downwardly as shown in FIG. 1. That is, it is dropped into and falls down a string of drill pipe as the pipe is removed from the well when making a trip. Assume for purposes of description that the well encounters blowout conditions causing a gas bubble at elevated pressure to travel up the drill stem. Alternately, assume that natural gas infiltrates the well and is diffused in the column of mud and thereby reduces the mud density. Whatever the situation, blowout conditions are accompanied with upward flow of drilling mud in the drill stem in contrast with the usual arrangement where the mud flows downwardly through the drill stem. If this occurs, there is a tendency to raise the equipment 10. If the slip assembly is installed, the centralizing bow springs 62 will drag against the wall of the drill pipe 11 and will relatively force the upper end downwardly, moving the plunger 59 upwardly into this chamber 56. When this relative movement occurs, the slip assembly is moved from the retracted position of FIG. 3 to the expanded position of FIG. 4, and tends to grip the wall of the drill pipe. It will hold at this position. In this position, upward mud flow is restrained, either partially or totally. Recall that the mud is forced downwardly below the wiping sleeve 25. Mud cannot flow upwardly through the mandrel 20 because there is a check valve installed in that flow path which prevents upward flow and which permits only downward flow. Mud is restrained in flowing upwardly around the exterior because of the sleeve. It is possible for the sleeve to be flattened by mud flow from above, but the sleeve generally will hold against fluid flow from below, and even when it does not hold, it will choke the flow, providing a choking action and requisite column weighting. Fluid flow up through the mandrel is blocked by the check valve and is choked by the sleeve 25 in the annulus as described; this will permit some control, typically aequate control to be obtained so that the blowout is restrained. This is especially critical at those points in time where the drill stem is disconnected from the mud delivery system.

The foregoing is especially true in the event a blowout is initiated and the drill stem is open at the top end. It is conceivable that the apparatus of this disclosure will slide somewhat before taking an adequate gripping set against the pipe by slip engagement. It might even slide to the upset thereabove and wedge against that. That possibility arises from the outward deflection of the slip segments shown in FIG. 4. They would provide special gripping of the pipe in that situation.

The present apparatus is intended primarily as a wiping mechanism and its ability to hold against a blowout is of secondary value. It will, however, hold against blowouts of modest pressure drive, but it likely will not hold against blowout with a tremendous pressure drive therebelow. In any case, the present apparatus is a device for either preventing blowout through the open drill stem or moderating the flow of fluid which makes a blowout dangerous to personnel and equipment.

This device should not be considered to be a qualified blowout preventer, but rather a limited capacity pressure delay device and a method of preventing the tool from being blown out of the hole.

While the foregoing is directed to the preferred embodiment and further discusses and describes an alternative enhancing accessory therefore, the scope of the present disclosure is determined by the claims which follow.

What is claims is:

1. A wiping apparatus adapted to be placed in a drill stem when pulling the drill stem from a well borehole wherein the apparatus comprises:

(a) an elongate mandrel having a passage therethrough for free fall in the drill stem;

(b) an elongate sleeve telescoped around said mandrel for wiping movement thereabout wherein said sleeve comprises:

(i) spaced upper and lower ends having a sufficiently narrow diameter to pass through internal upset pipe without contact against the internal upset pipe;

(ii) a central expanded bulge between said ends thereof and sized to contact the inside wall of the pipe making up the drill stem;

(iii) said sleeve being formed of resilient material permitting reduction in diameter when encountering an internal upset in the pipe making up the drill stem; and (iv) wherein said sleeve has a bias causing said sleeve to expand radially outwardly to contact against and wipe the interior wall of the pipe and wherein flexure occurs on entry into and departure from internal upsets;

(c) means controllably limiting movement of said sleeve along said mandrel;

(d) valve means connected with the passage of said mandrel for defining a controlled fluid flow pathway through said mandrel permitting downward flow and blocking upward flow; and (e) adjustable weight means for controlling the weight of the present apparatus to controllably free fall in the drill stem to the top end of the column of drilling fluid in the drill stem and to wipe drilling fluid downwardly as the drill stem is pulled from the well borehole.

2. The apparatus of claim 1 wherein said mandrel includes an upper shoulder facing upwardly, and a lower shoulder facing downwardly, and said shoulders permit movement of said sleeve within limits established by said shoulders, and wherein said sleeve can elongate on passing through an internal upset to thereby move one or the other end of said sleeve away from said shoulders.

3. The apparatus of claim 2 wherein said shoulders comprise upwardly and downwardly facing rings respectively on said mandrel, and said sleeve further comprises reinforcing rings affixed to and on the interior of said sleeve.

4. The apparatus of claim 3 wherein said adjustable weight means comprises:

(a) an enlarged body portion at the lower end of said mandrel;

(b) a protruding knuckle means affixed to the upper end of a weight bar; and (c) cavity means within said body portion larger than said knuckle means and adapted to receive said knuckle means releasably thereinto, and further including locking means removably fastened in said cavity means to secure said knuckle means therein.

5. The apparatus of claim 4 including a narrow neck supporting said knuckle means and further including an axially aligned opening in said body portion receiving said neck therethrough terminating at said knuckle means to support said weight bar therebelow.

6. The apparatus of claim 5 further including an encircling surface in said cavity supporting said knuckle means for rotation to enable said weight bar to deflect.

7. The apparatus of claim 5 including multiple weight bars connected by knuckle means serially below said mandrel.

8. The apparatus of claim 1 wherein said mandrel supports:

(a) an upper sub at the top end thereof;
(b) a lower sub at the lower end thereof;
(c) passages in said upper and lower subs connecting to said mandrel passage; and
(d) upper and lower rings on said mandrel limiting said sleeve in movement along said mandrel.

9. The apparatus of claim 1 wherein said mandrel supports an enlarged sub at the upper end and said sub has an industry standard fishing neck thereon, and said mandrel supports a separate sub at the lower end, and said lower sub houses an outlet for the passage through said mandrel, and said mandrel passage connects to a check valve means recessed within the lower sub.

10. The apparatus of claim 1 wherein said sleeve is circular in cross section, bowed symmetrically between the ends thereof to thereby define said central bulge, formed of resilient material presenting a surrounding and encircling ring shaped surface at said central bulge, and has a relaxed diameter equal to or greater than the inside diameter of drill pipe in the drill stem.

11. A wiping apparatus adapted to be placed in a drill stem when pulling the drill stem from a well borehole, the apparatus comprising:

(a) an elongate weighted mandrel;
(b) an elongated sleeve telescoped around said mandrel for wiping movement thereabout wherein said sleeve comprises:
  (i) spaced upper and lower ends having a sufficiently narrow diameter to pass through internal upset pipe without contact against the internal upset pipe;
  (ii) a central expanded bulge between said ends thereof and sized to contact the inside wall of the pipe making up the drill stem;
  (iii) said sleeve being formed of resilient material permitting reduction in diameter when encountering an internal upset in the pipe making up the drill step; and
  (iv) wherein said sleeve has a bias causing said sleeve to expand radially outwardly to contact against and wipe the interior wall of the pipe and wherein flexure occurs on entry into and departure from internal upsets;
(c) means controllably limiting movement of said sleeve along said mandrel.

12. The apparatus of claim 11 wherein said sleeve further includes fixed diameter, end located rings formed of material stiffer than said resilient material and said rings encircle said mandrel, and further including means permitting limited ring movement along said mandrel.

13. The apparatus of claim 12 wherein said rings are attached to said sleeve, and said sleeve has said central bulge, said bulge forms a bulge symmetrically between said ends, and said mandrel extends above and below said sleeve to support and align said sleeve within drill pipe; and further including upper and lower means joined to said mandrel having a diameter sufficiently large to align said mandrel relative to internal upsets in drill pipe so that the lower end of said sleeve passes through internal upsets without contact and said sleeve bulge contacts a surrounding internal upset circumferentially.

14. The apparatus of claim 13 further including a chamber within said central expanded bulge and said chamber partially collapses on contact of an internal upset with said sleeve.

15. A method of pulling a dry pipe joint on tripping a drill stem from a well borehole, the method comprising the steps of:

(a) from the upper end of the drill stem, dropping a mandrel centered sleeve into the top most drill pipe;
(b) sizing upper and lower ends of the sleeve on the mandrel sufficiently small so that said sleeve ends pass through an internal upset of the pipe without contacting the internal upset;
(c) wiping the pipe inside wall between internal upsets with a central bulge on said sleeve to force drilling fluid downwardly as wiped;
(d) reducing the diameter of the sleeve bulge on passing said bulge through an internal upset;
(e) supporting said sleeve above the column of drilling fluid in the drill stem; and
(f) removing the top most drill pipe after wiping after directing the mandrel centered sleeve into the next drill pipe.

16. The method of claim 15 including the step of controllably weighting the mandrel centered sleeve to fall to drilling fluid in the drill stem while maintaining the mandrel centered sleeve above the drilling fluid.

17. The method of claim 16 including the step of weight bars to increase the weight.

18. The method of claim 15 including the step of permitting axial movement of the sleeve along the mandrel between limits.

19. The method of claim 15 including the step of sizing the sleeve equal to or larger than the inside wall of the drill pipe, and including the further step of sizing the ends of the sleeve smaller in diameter than the drill pipe internal upsets.

* * * * *